United States Patent [19]

Bhat et al.

[11] 4,080,944

[45] Mar. 28, 1978

[54] GLOW PLUG WITH IDLE BAR

[75] Inventors: Vasanth K. Bhat, Cincinnati; Allen E. Siegel, Loveland; Richard E. Vogel; Larry G. Burrows, both of Cincinnati, all of Ohio

[73] Assignee: Emerson Electric Co., St. Louis, Mo.

[21] Appl. No.: 696,724

[22] Filed: Jun. 16, 1976

Related U.S. Application Data

[63] Continuation-in-part of Ser. No. 594,560, Jul. 9, 1975.

[51] Int. Cl.[2] ..... F23Q 7/10

[52] U.S. Cl. ..... 123/145 A; 123/145 R

[58] Field of Search ..... 123/145 R, 145 A, 143 R, 123/143 A, 143 B, 169 EL; 313/141; 317/94, 98; 60/39.82 N

[56] References Cited

U.S. PATENT DOCUMENTS

| | | | |
|---|---|---|---|
| 3,297,914 | 1/1967 | Saintsbury | 123/145 R X |
| 3,434,012 | 3/1969 | Rademacher | 123/145 A X |
| 3,689,195 | 9/1972 | Beesch et al. | 123/145 A X |
| 3,911,326 | 10/1975 | Ohlsson | 123/145 A X |

FOREIGN PATENT DOCUMENTS

| | | | |
|---|---|---|---|
| 96,048 | 11/1960 | Netherlands | 123/145 A |

*Primary Examiner*—Charles J. Myhre
*Assistant Examiner*—Tony M. Argenbright
*Attorney, Agent, or Firm*—Polster, Polster and Lucchesi

[57] ABSTRACT

In a glow plug igniter of the type used in internal combustion engines, having a hollow cylindrical casing and a central pin-terminal, a substantially flat-spiral-coiled resistance element, flexible in a direction out of its plane, oriented perpendicularly to the pin-terminal with one end electrically connected to the casing and the other to the pin-terminal, is positioned at a nose end of the casing and spaced from a backing seal of temperature and corrosion-resistant, electrically insulating material hermetically closing the hollow casing. An idle bar of substantial width relative to the resistance element, bridges across the nose end of the casing, spaced from the resistance element. Preferably, the casing is crenellated, with opposed merlons, provided with weld projections, to which the ends of the idle bar are welded.

12 Claims, 13 Drawing Figures

GLOW PLUG WITH IDLE BAR

CROSS REFERENCE TO RELATED APPLICATION

This application is a continuation-in-part of application, Ser. No. 594,560, filed July 9, 1975.

BACKGROUND OF THE INVENTION

This invention has particular application to glow plugs used in internal combustion engines of model airplanes of the radio controlled type. In such engines, reliability is of great importance. The abilities to idle or run at low speed and then quickly to accelerate smoothly, without faltering or hesitating (staggering), to high speed and smoothly to decelerate from high speed to low, are all essential.

The conditions of operation and the performance requirements of the glow plugs of radio controlled model airplane engines are different from those involved in engines used for racing. Furthermore, it is desirable in glow plugs used in radio controlled aircraft engines to have a much longer effective life than that of racing plugs, which, as explained in the application of which this is a continuation-in-part, are commonly used for one flight or at the most two or three.

One of the objects of this invention is to provide a glow plug for radio controlled model aircraft which minimizes or eliminates stagger, and provides either a faster top speed or better fuel efficiency at the same speed than such plugs known heretofore.

Another object is to provide such a plug which is durable and dependable.

Still another object is to provide a high quality plug which is easy to manufacture.

Other objects will become apparent to those skilled in the art in the light of the following description and accompanying drawing.

SUMMARY OF THE INVENTION

In accordance with this invention, generally stated, a glow plug igniter of the type used in small two-cycle internal combustion engines, having a hollow cylindrical casing and a central pin-terminal is provided in which a substantially flat-spiral-coiled resistance element is flexible in a direction out of its initial plane and is oriented perpendicularly to the axis of the pin-terminal (sometimes also referred to herein as the terminal pin), is positioned at a nose end of the casing and spaced from a backing seal of temperature and corrosion resistant electrically insulating material hermetically closing the hollow casing. The casing may be crenellated, with opposed merlons, preferably provided with weld projections to which ends of a flat idle bar are welded, or the idle bar may be U-shaped, preferably with weld projections at its free ends, which are welded to a plane radial surface of the nose of the casing. The idle bar is wide relative to the resistance element, and provides protection to the resistance element. The resistance element is formed of generally round wire, one end of which is connected to the terminal pin, and the other to the casing, and is free of engagement with any part of the seal or other backing between the terminal pin and the casing.

In making the glow plug, the terminal pin is preferably sealed into the casing by means of a seal of a vitreous or partially crystallized glass at the nose end. The seal of heat and corrosion resistant material is secured to and completely closes the nose end of the plug behind the resistance element, adjacent the element but spaced therefrom through at least a major portion of the radial extent of the element. The nose seal may extend the entire distance to the opposite end of the plug, or a second seal, either contiguous the nose seal or spaced axially from the nose seal, may serve with the nose seal as the sole means for mounting the terminal pin in the plug body. The ends of the resistance element are subsequently welded to the terminal pin and casing respectively, and thereafter, the idle bar is welded to the casing.

DESCRIPTION OF THE PREFERRED EMBODIMENT

Figure 4:
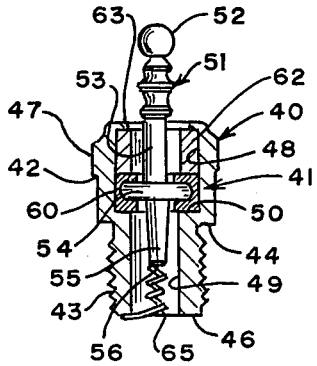
FIG. 4 is a sectional view of one form of conventional glow plug.

Referring now to the drawings, and particularly to FIG. 4, reference numeral 40 indicates a conventional glow plug for use in two-cycle racing engines for model airplanes. The glow plug 40 has a casing 41 with a body section 42 and a nose section 43 of a smaller diameter than the body section to define an annular shoulder 44 between them. The nose section is threaded, and has a flat radial end face 46. The body section has a hex nut 47 formed integrally on its outer wall, and a bore 48 of a diameter greater than a bore 49 of the nose section, to define between them an annular seat 50. A terminal pin 51 is centered in the concentric bores 48 and 49. The terminal pin 51 has a ball 52 at its outer end, to which a conventional quick disconnect electrical fitting can be attached, a shank portion 53, an annular outwardly radially extending flange 54, and a tapered shaft section 55 terminating in a flat end surface 56.

The pin 51 is mounted in the body of the plug by means of plastic or fiber insulators 60, upper and lower ones of which together form a ring, U-shaped in cross section to form a channel within which the flange 54 is seated. The insulators 60 are seated on the seat 50 and bear against the inside surface of the bore 48. The insulators, hence the flange and pin, are held in place within the body by means of a spacing sleeve 62, which in turn is held against axially outward movement by a rolled edge 63 of the body section 42.

A helical resistance element 65, one end of which is welded to the end surface 56 of the terminal pin, and the other end of which is welded to the end face 46 of the nose section of the plug, extends for the most part axially of the bore 49. It will be observed that between the flange 54 and the nose end face 46, the bore 49 is substantially open, and that almost all of the resistance element 65 lies within the confines of the bore 49.

Figure 2:
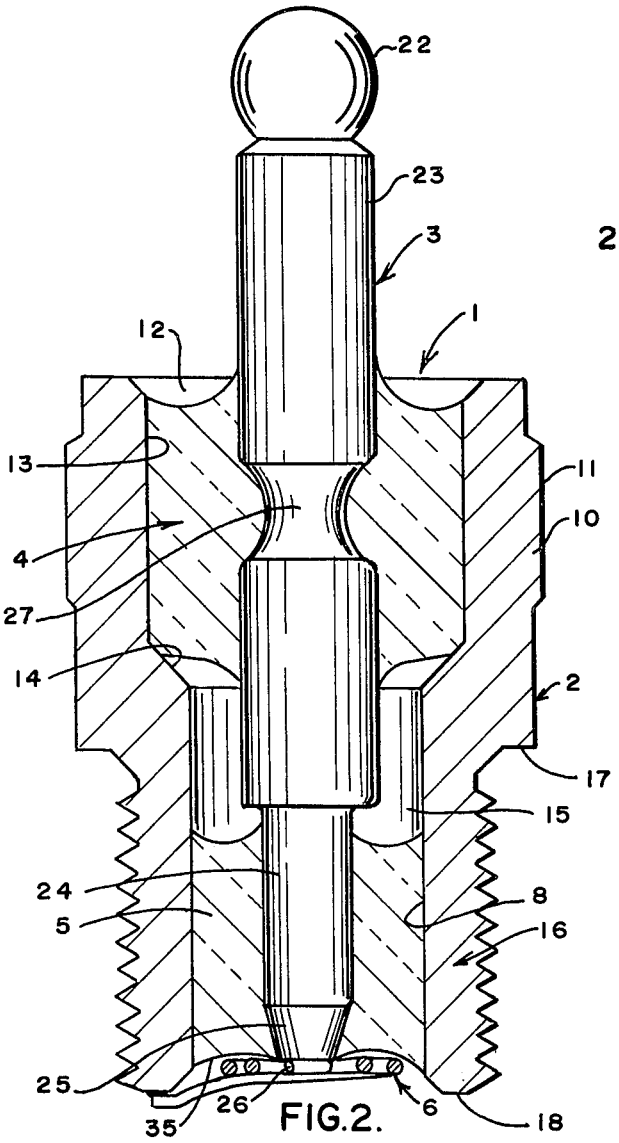
FIG. 2 is a sectional view taken along the line 2—2 of FIG. 1.
Figure 1:
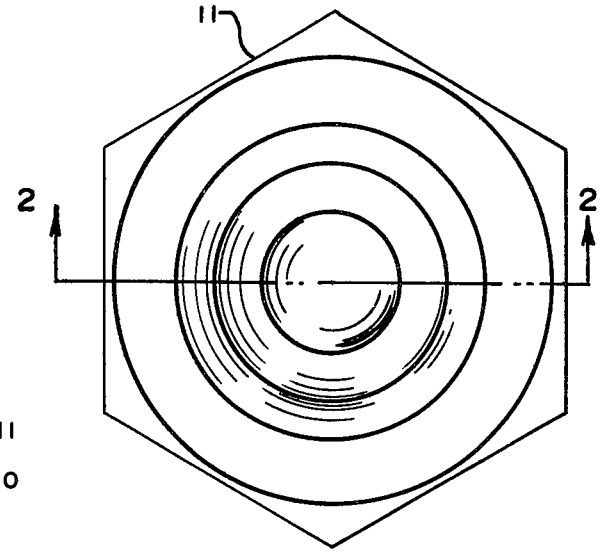
FIG. 1 is a top plan view of an illustrative embodiment of glow plug for racing engines as described in the patent application of which this is a continuation-in-part.
Figure 3:
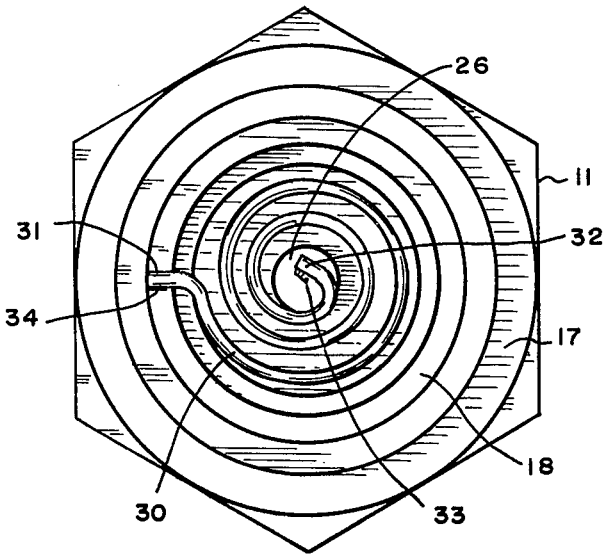
FIG. 3 is a bottom plan view of the device shown in FIGS. 1 and 2.

Referring now to FIGS. 1–3 for an illustrative embodiment of racing glow plug, as described in our application Ser. No. 594,560, which will be described for the sake of completeness, reference numeral 1 indicates the glow plug. The glow plug is made up of a casing 2, a terminal-pin 3, an outboard seal 4, an inboard or nose seal 5 and a resistance element 6.

The casing 2 has a body section 10 and a nose section 16. The body section has a hex nut 11 formed integrally with it on its outside, a bore or chamber 12 defined by cylindrical side wall 13 and a shoulder 14, connecting the side wall 13 to a side wall 8 of the nose section 16. The side wall 8 defines a bore 15 of smaller diameter than the diameter of the bore or chamber 12. The outer surface of the nose section is threaded conventionally. The nose section 16 is of smaller diameter than the outside diameter of the body section 10, defining between them a shoulder 17 which is also conventional. The nose section 16 has on its inboard end a radially flat surface 18. Both the nose and the body may have internal chamfers at the outer ends of the bores 12 and 15 respectively.

The terminal pin 3 has a ball 22 at its outer end, corresponding to the ball 52 of the conventional glow plug shown in FIG. 4. The pin has a heavy cylindrical shank section 23, a relatively short reduced shaft section 24 with an annular bevel 25 at its lower end, and a flat radial end surface 26. In the embodiment shown, the shank 11 is provided with an annular groove 27 about midway axially of the seal 4. The shank 11 can also be straight sided, or provided with a plurality of annular grooves.

The resistance element 6 of this embodiment is an elongated wire 30, wound in a flat spiral configuration. It has an outer end 31, extending out of the plane of the rest of the spiral in order to overlap the flat face 18 of the nose section of the casing, welded at 34 to the flat face 18, and an inner end 32, welded at 33 to the flat end 26 of the terminal pin.

In this embodiment, the outboard seal 4 is a glass seal fused to the side wall 13 of the casing and to the shank 23 of the pin. The nose seal 5 is also a glass seal, fused to the side wall 8 of the casing and to the shaft section 24 of the pin. The glass nose seal 5 may be made more refractory by the addition to the glass of 5 to 25% crystalline ceramic particles. The outboard seal 4 can also contain crystalline ceramic additives. In any event, the fusing and bonding characteristics are those of glass, and the term glass is used herein to embrace any composition in which glass predominates, regardless of the amount or character of other additives.

The wire making up the spiral element 6 is spaced slightly from the adjacent surface of the seal 5.

It will be observed that the inboard and outboard seals, fused to the walls 8 and 13 and the shaft and shank sections 24 and 23, respectively, constitute the sole means for mounting the pin 3 within the casing 2.

In the manufacture of the plug of this embodiment, two annular, cylindrical, sintered pellets essentially of powdered glass but with any desired additives such as alumina in the nose seal pellet and of the desired size are positioned around the pin 3 and within the bores of the casing 2, and the assembly heated to fuse the glass to the pin and bore walls. The spiral element 6, which, in this embodiment, is made of platinum rhodium wire, can simply be laid in position with the end 31 on the nose surface 18 and the end 32 on the pin surface 26, and welded after the rest of the plug has been assembled.

Figure 5:
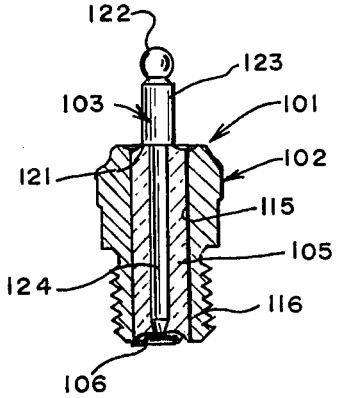
FIG. 5 is a sectional view of another embodiment of racing plug.

Referring now to FIG. 5 for another embodiment of racing glow plug, reference numeral 101 indicates the complete plug which includes a casing 102, a pin-terminal 103, a single seal 105 and a resistance element 106. Externally, the casing 102 can be substantially the same as the casing 2 of the embodiment of FIGS. 1–3. Internally, the casing 102 is shown as having a single cylindrical bore 115 extending axially through the casing. The pin-terminal 103 has a shaft 124 extending axially through most of the length of and concentrically with the bore 115. The pin-terminal has a heavy shank 123 projecting from the outer end of the casing 102 and is provided at its outer end with a terminal ball 122.

The seal 105 extends from the open end of a nose section 116 of the casing 102 to the outer end of the casing, is fused to the side wall of the bore 115 and to the shaft 124 to form a hermetic seal. The seal 105 also fuses to the surface of an annular shoulder 121 formed between the shank 123 and the shaft 124, so that the external appearance of the finished plug is substantially the same as that of the plug of the first embodiment. The element 106 can be identical in side, shape and configuration with the element 6 of the first embodiment, and its position with respect to the nose surface of the seal 105 is the same as that of the plug of the first embodiment, with respect to the nose seal 5. The embodiment of FIG. 5 has some advantage of simplicity over the first embodiment but it does not permit quite as much flexibility in construction as far as the use of different types of nose and outer seals is concerned.

Figure 6:
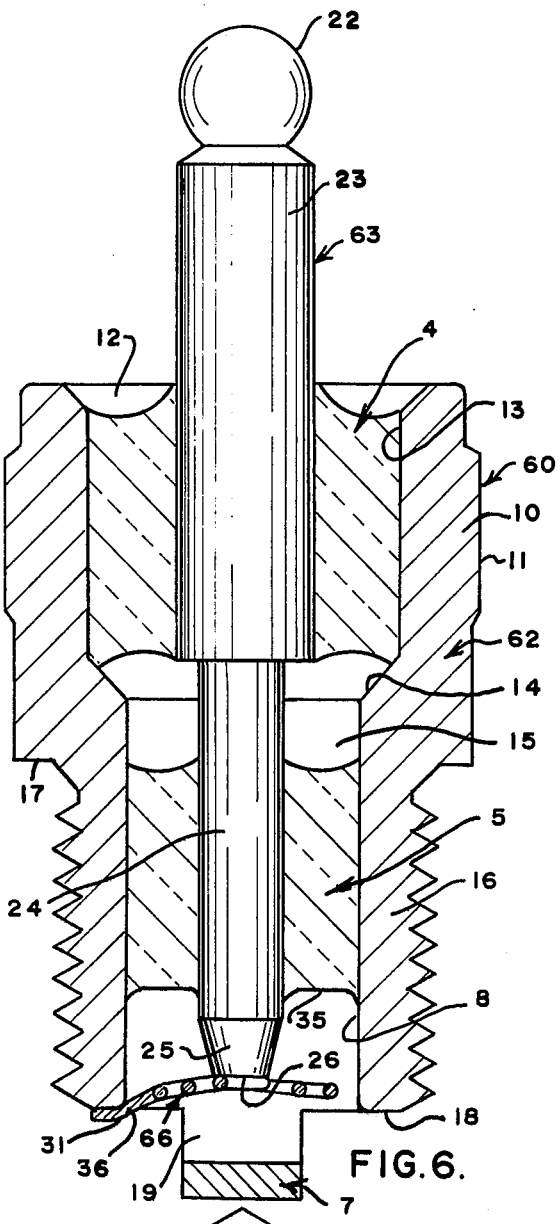
FIG. 6 is a sectional view of one illustrative embodiment of glow plug for radio controlled model aircraft engines of this invention, taken along the line 6—6 of FIG. 7.
Figure 7:
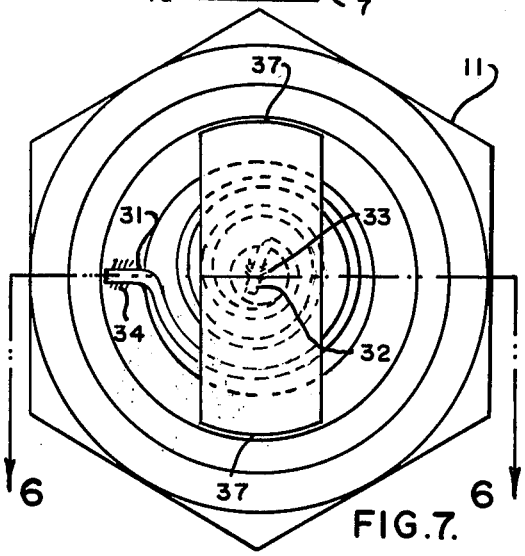
FIG. 7 is a bottom plan view of the glow plug of FIG. 6.

Referring now to FIGS. 6–9 for one illustrative embodiment of the glow plug of the present invention, the reference numerals used will correspond with those used in the description of the racing plug of FIGS. 1–3 to the extent that the elements of the two types of plug are the same. The complete plug shown in FIGS. 6 and 7 is indicated by the reference numeral 60. The plug 60 has a casing 62, a terminal pin 63, an outboard seal 4, an inboard or nose seal 5, a resistance element 66, and an idle bar 7. The casing 62 has a body section 10 and a nose section 16. The body section has a hex nut 11 formed integrally with it on its outside, a bore or chamber 12 defined by a cylindrical side wall 13, and a shoulder 14, connecting the side wall 13 to a side wall 8 of the nose section 16. The side wall 8 defines a bore 15 of smaller diameter than the diameter of the bore or chamber 12. The outer surface of the nose section is threaded conventionally. The outside diameter of the nose section 16 is smaller than the outside diameter of the body section 10, defining between them a shoulder 17 which is also conventional. The nose section 16 has on its inboard end a radially flat surface 18, relieved along its radially inner edge.

The radially flat surface 18 in the plug 60 is interrupted symmetrically by merlons 19, which are axial extensions of the nose section 16 of the casing 62.

Figure 8:
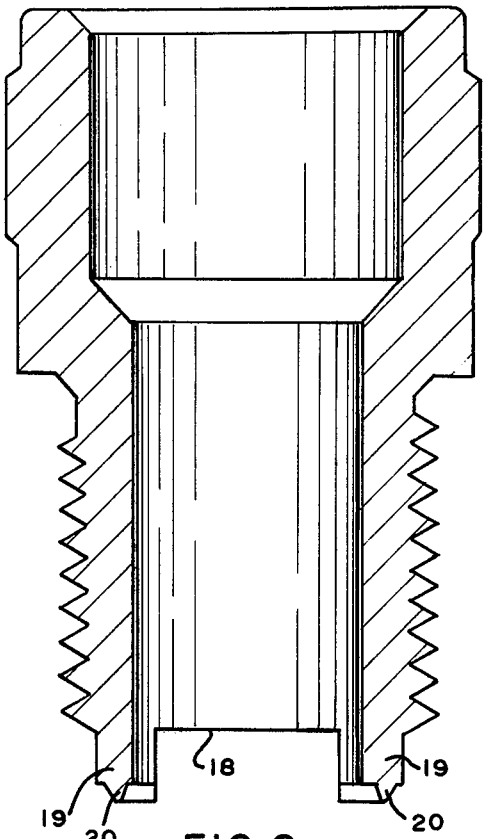
FIG. 8 is a sectional view of the casing of the glow plug of FIG. 6 taken along the line 8—8 of FIG. 9.
Figure 9:
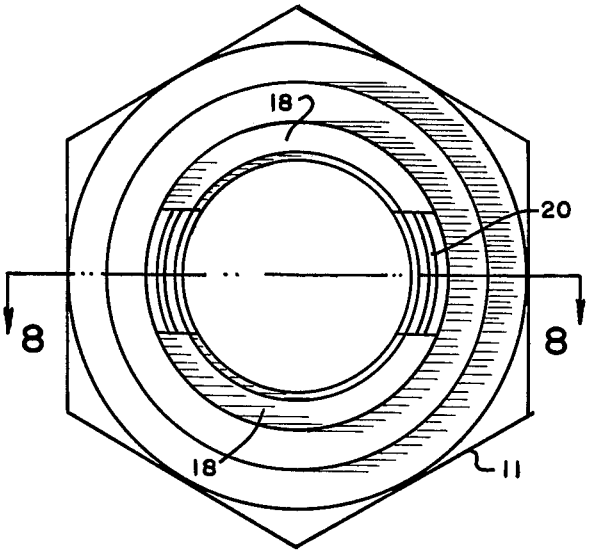
Figure 10:
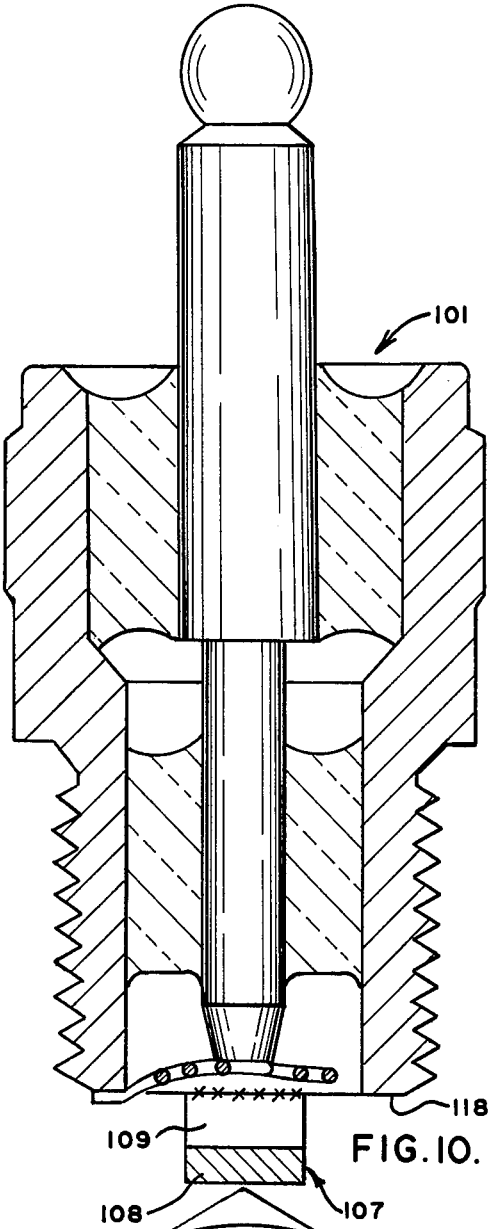
FIG. 10 is a sectional view, taken along the line 10—10 of FIG. 11, of another embodiment of glow plug for radio controlled model aircraft engines of this invention.
Figure 11:
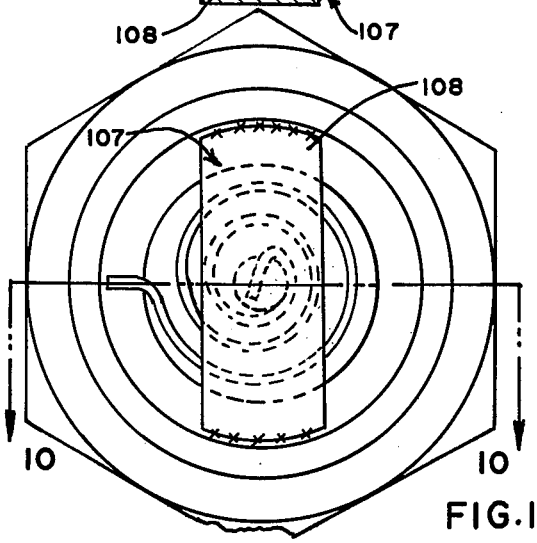
Figure 13:
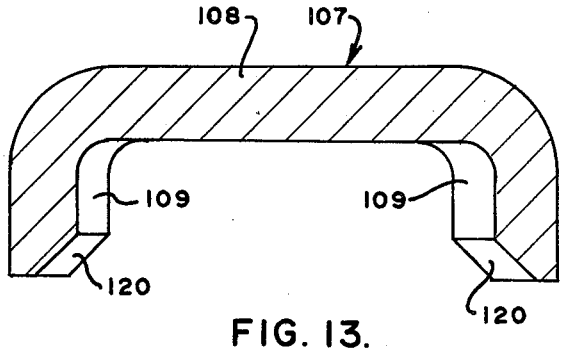
FIG. 13 is a sectional view taken along the line 13—13 of FIG. 12.

The outer surfaces of the merlons 19 are not threaded, and are of an outside diameter slightly smaller than the root diameter of the threads on the exterior surface of the nose section 16. Before the plug 60 is assembled, the axially outer ends of the merlons 19 have weld projections 20 extending from them, as shown in FIGS. 8 and 9.

The terminal pin 63, of this embodiment, differs from the terminal pin 3 of the racing plug in two respects: the annular groove 27 is omitted, and the shank and shaft sections are somewhat differently proportioned. The terminal pin 63 has a ball 22 at its outer end, a heavy cylindrical shank section 23, a reduced shaft section 24 with an annular bevel 25 at its lower end, and a flat radial end surface 26.

The resistance element 66 of this embodiment is an elongated wire 36, round in cross section, wound in a flat spiral configuration. It has an outer end 31, extending out of the plane of the rest of the spiral in order to overlap the flat face 18 of the nose section of the casing, welded at 34 to the flat face 18, and an inner end 32, welded at 33 to the flat end 26 of the terminal pin. In the preferred embodiment, the wire 36 is longer than the wire 30 of the racing plug. The element 66 is positioned at about the same distance axially from the flat face 18, as the element 6 of the racing plug is, but the axial distance between the element 66 and a facing surface 35 of the inboard seal 5 is substantially greater than the distance of the element 6 from the meniscus 35 in the racing plug.

The idle bar 7 is a flat bar, wide relative to its thickness, and rounded at its two ends on a radius only slightly less than the outer radius of the merlons 19. The idle bar is welded at its ends to the merlons, and bridges from one to the other of the merlons across the nose of the casing. The distance between the facing surface of the idle bar and the face 18 of the nose is, in the embodiment shown, about half the distance between the flat surface 18 and the surface 35 of the inner seal 5. The width of the idle bar in this embodiment is slightly more than half the diameter of the bore 8, and is approximately the same as the distance between the surface 18 and the surface 35.

Merely by way of illustration and not of limitation, in a glow plug 60 0.770 inch long overall, with a casing 0.505 inch long, a nominal major diameter of the threaded nose section 16 of 0.250 inch and a root diameter of 0.223 inch, an inside diameter of the body chamber 12 of 0.209 inch and of the nose bore 15 of 0.156 inch, the nose bore extending 0.295 inch from the outer surface 18 to the outer edge of the shoulder 14, a pin 63 0.690 inch long with a shank 23 0.326 inch long, excluding the sphere 22 which is 0.094 inch in diameter, and a shaft 24 0.270 inch long and 0.062 inch in diameter, bevelled at its free end to provide a radial flat surface 26 0.039 inch in diameter, the flat surface 26 of the terminal pin can be recessed 0.020 inch from the plane of the flat surface 18. The surface 35 can be 0.080 inch from the flat surface 18, and 0.060 inch from the radial surface 26 of the pin. The distance between the flat surface 18 and the facing surface of the idle bar can be 0.035 inch.

The idle bar 7 can be 0.080 inch wide, 0.025 inch thick, and 0.205 inch long.

The wire 36 can be 80% platinum and 20% rhodium, 0.008 inch in diameter and 1.000 inch in length, coiled so as to form a flat spiral 0.110 inch across at the point at which the outer end 31 leaves the plane of the spiral and 0.063 inch from the center of the plug to the point at which the outer end 31 is bent to project substantially radially outwardly.

The preferred embodiment of this invention uses two glass seals, fused to the side walls of the bores of the casing and to the shaft and shank of the pin. However, because the engines of the radio controlled model airplanes are not exposed to heat as intense as those of the racing type, the outer seal, particularly, may be made of high temperature plastic or the like. As in the embodiment of racing plug shown in FIG. 5, a single seal can be used also. It is also possible to metallize and braze in place, or glass-coat and fuse in place, or join with a glass pellet, a ceramic washer to form a nose seal.

The relationships of the dimensions and relative spacings of the nose seal inner surface, resistance element and idle bar are important.

The idle bar itself serves several functions. It affects the admixture and distribution of the fuel at the place of ignition and the heat sink characteristics of the plug, and it also serves to protect the resistance element from bits of metal which might otherwise tend to foul the resistance element. The idle bar can be made in other shapes. For example, if the casing of the plug is not crenellated, the idle bar can be made U-shaped, the legs of the U serving the function of the merlons of the crenellated plug.

The wire of the resistance element is described as round. However, other shapes, such as elliptical, can be used. In the case of the elliptical cross section, the minor axes should be parallel with the axis of the pin terminal, to ensure flexibility in the direction out of the plane of the coil. A ribbon type resistance element, in which the width of the ribbon is parallel to the axis of the pin, has been found unsatisfactory, because of the rigidity inherent in such a configuration.

The wire has been described as being made of 80% platinum and 20% rhodium. It has been found that with the plug of this invention, as little as 10% rhodium can be used and 90% platinum.

In the embodiment of the present invention shown in FIGS. 10 through 13, the plug 101 is identical with the plug 60 shown in FIG. 6, except in two respects. First, the nose of the casing is not crennelated but planar, a radially flat surface 118 extending uninterruptedly around the nose of the plug. Second, the idle bar is a U-shaped member 107, with a central span 108 and two legs 109, welded at their outer ends to the surface 118. Before the idle bar 107 is welded to the casing, weld projections 120, integral with the outer ends of the legs 109, extend from the legs. The weld projections 120, like the weld projections of the embodiment shown in FIGS. 6 through 9, are wedge-shaped in section, although of slightly different profile in the illustrative embodiments shown, their relatively sharp edges serving to create a high resistance during the resistance welding process by which they are secured to the casing, facilitating the welding. In the illustrative embodiments, the weld projections 20 have a crest height on the order of 0.007 inch to 0.012 inch, and the weld projections 120 have a crest height on the order of 0.010 inch to 0.016 inch, when the other dimensions of the glow plug are as given in the illustrative examples. The "sharp" edge of the weld projection is preferably no wider than 0.010 inch.

The finished dimensions of the glow plug 101 can be about the same as those of the glow plug 60. Thus, in an illustrative example of possible dimensions of the glow plug 101, the overall length can be 0.770 inch, the idle bar 107 can be 0.080 inch wide and 0.025 inch thick, and the central span 108 can be 0.190 inch long. The legs 109 can be 0.035 inch long from the surface 118 to the underside of the central span, after the welding is completed.

Figure 12:
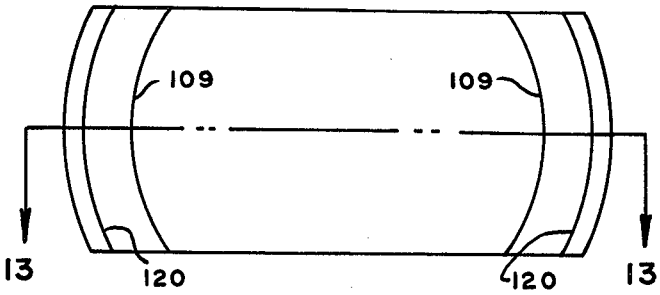
FIG. 12 is an enlarged plan view of an idle bar of the embodiment of glow plug shown in FIGS. 10 and 11, before being welded to the casing of the plug.

As is shown especially in FIG. 12, the legs 109 are formed on an arc coincident with the circular face of the nose section of the casing, the inside surface of the legs being on a circle with a diameter of 0.140 inch, in a plug the illustrative dimensions of which have been given.

An advantage of the plug 101, from the manufacturing point of view, is that it can be made utilizing the same casing as the racing plug 1 illustrated in FIGS. 1–3.

Numerous other variations in the construction of the plug of this invention, within the scope of the appended claims will occur to those skilled in the art in the light of the foregoing disclosure.

Having thus described the invention, what is claimed and desired to be secured by Letters Patent is:

1. In a glow plug igniter of the type used in small two-cycle internal combustion engines, having a hollow cylindrical casing and a central pin-terminal, the improvement comprising a substantially flat-spiral-coiled, flexible resistance element one end of which is electrically connected to said casing and the other to said pin-terminal, said element being oriented substantially perpendicularly to the axis of said pin-terminal and being free of support between the said pin-terminal and said casing, and an idle bar connected at its ends to said casing and spaced from said element in a direction away from said pin-terminal.

2. In a glow plug igniter of the type used in a small two-cycle internal combustion engine, having a cylindrical casing and a central pin-terminal, said casing having a passage, defined by a wall, extending axially through it and a nose section having a radial surface at its axially inboard end at which it is intended to communicate with a cylinder of said engine, the improvement comprising an electrically insulating seal bonded to said passage-defining wall of said casing and to said pin-terminal, said seal extending within said nose section, electrically insulating said pin from said casing and hermetically closing the passage in said casing, said seal being recessed within said passage from the said inboard end of said nose section; a substantially flat-spiral-coiled, flexible resistance element one end of which is electrically connected to said pin-terminal and the other end of which is electrically connected to said casing, said element being oriented substantially perpendicularly to the axis of said pin-terminal and being spaced from said seal through its entire radial extent, and an idle bar connected at its ends to said casing to bridge said nose section and spaced from said element in a direction away from said pin-terminal.

3. The improvement of claim 2 wherein the resistance element is round in cross section.

4. The improvement of claim 2 wherein the nose section is crenellated, with opposed merlons, and said idle bar is flat and is welded at its ends to said merlons.

5. The improvement of claim 4 wherein the merlons have at their outer edge weld projections to which the ends of said idle bar are welded.

6. The improvement of claim 2 wherein the diameter of the bore of the nose section of the casing is about 0.156 inch, the inboard surface of the seal is recessed about 0.060 inch from the inboard end of the pin-terminal, and the facing surface of a bridging section of the idle bar is spaced about 0.055 inch from the said inboard end of the pin-terminal.

7. The improvement of claim 6 wherein the said idle bar is at least 0.080 inch wide.

8. The improvement of claim 2 wherein said idle bar is U-shaped, with legs welded at their free ends to said radial surface of said nose section of said casing.

9. The improvement of claim 8 wherein the legs initially have at their outer edges weld projections by which the legs are welded to the casing.

10. The method of making a glow plug comprising sealing a pin-terminal having a radial surface on its inboard end in the bore of an open-ended hollow cylindrical casing having a nose section with at least one radial surface at its axially inboard end at which it is intended to communicate with a cylinder of an engine; thereafter welding two ends of a substantially flat-spiral-wound resistance element of substantially circular cross section to said radial surface of said inboard end of said pin-terminal and to said radial surface of said nose section of said casing, respectively.

11. The method of claim 10 including the subsequent step of welding an idle bar across said casing, said idle bar having a bridging section spaced axially inboard of said resistance element.

12. The method of making a glow plug comprising sealing a pin-terminal in the bore of an open-ended hollow cylindrical casing having a nose section crenellated at its inboard end, with opposed merlons having weld projections thereon; thereafter welding two ends of a substantially flat-spiral-wound resistance element to an inboard end of said pin-terminal and to an inboard surface of the nose of said casing, respectively, and subsequently positioning an idle bar across said casing, said idle bar having a bridging section spaced axially inboard of said resistance element, and welding the ends of said idle bar to the weld projections of opposed merlons.

* * * * *